US011293594B2

(12) United States Patent
Ben Belgacem-Strek et al.

(10) Patent No.: US 11,293,594 B2
(45) Date of Patent: Apr. 5, 2022

(54) METHOD AND SYSTEM FOR THE REAL-TIME CALCULATION OF THE AMOUNT OF ENERGY TRANSPORTED IN A NON-REFRIGERATED, PRESSURISED, LIQUEFIED NATURAL GAS TANK

(71) Applicant: ENGIE, Courbevoie (FR)

(72) Inventors: Michel Ben Belgacem-Strek, Paris (FR); Gabrielle Menard, Paris (FR); Frédéric Legrand, Paris (FR)

(73) Assignee: ENGIE, Courbevoie (FR)

( * ) Notice: Subject to any disclaimer, the term of this patent is extended or adjusted under 35 U.S.C. 154(b) by 654 days.

(21) Appl. No.: 16/314,590

(22) PCT Filed: Jun. 14, 2017

(86) PCT No.: PCT/FR2017/051541
§ 371 (c)(1),
(2) Date: Dec. 31, 2018

(87) PCT Pub. No.: WO2018/002467
PCT Pub. Date: Jan. 4, 2018

(65) Prior Publication Data

US 2019/0226640 A1 Jul. 25, 2019

(30) Foreign Application Priority Data

Jun. 30, 2016 (FR) ..... 1656241

(51) Int. Cl.
*F17C 13/02* (2006.01)

(52) U.S. Cl.
CPC ..... *F17C 13/021* (2013.01); *F17C 13/02* (2013.01); *F17C 13/026* (2013.01);
(Continued)

(58) Field of Classification Search
CPC ..... F17C 13/021; F17C 13/02; F17C 13/026; F17C 2250/0404; F17C 2250/0491;
(Continued)

(56) References Cited

U.S. PATENT DOCUMENTS 5,900,535 A * 5/1999 Doe ..... G01N 29/024 73/32 A
6,157,894 A * 12/2000 Hess ..... B64D 37/00 702/141
(Continued)

FOREIGN PATENT DOCUMENTS

CA 2728505 A1 12/2009
CA 2753588 A1 3/2013
(Continued)

OTHER PUBLICATIONS

Nov. 10, 2020 Notice of Reasons for Refusal issued in Japanese Patent Application No. 2018-568246 with English translation.
(Continued)

*Primary Examiner* — Nicolas A Arnett
(74) *Attorney, Agent, or Firm* — Kenealy Vaidya LLP

(57) ABSTRACT

Some embodiments of the presently disclosed subject matter relate to a method and system for the real-time calculation of the amount of residual chemical energy in a non-refrigerated, pressurised tank containing liquefied natural gas, without a composition of the liquefied natural gas having to be determined.

7 Claims, 4 Drawing Sheets

(52) U.S. Cl.
CPC ..... *F17C 2201/0104* (2013.01); *F17C 2201/0128* (2013.01); *F17C 2201/032* (2013.01); *F17C 2201/035* (2013.01); *F17C 2201/056* (2013.01); *F17C 2221/033* (2013.01); *F17C 2223/0161* (2013.01); *F17C 2223/033* (2013.01); *F17C 2250/032* (2013.01); *F17C 2250/0404* (2013.01); *F17C 2250/0408* (2013.01); *F17C 2250/0421* (2013.01); *F17C 2250/0439* (2013.01); *F17C 2250/0456* (2013.01); *F17C 2250/0469* (2013.01); *F17C 2250/0473* (2013.01); *F17C 2250/0491* (2013.01); *F17C 2250/0495* (2013.01); *F17C 2250/0694* (2013.01); *F17C 2260/026* (2013.01); *F17C 2265/066* (2013.01); *F17C 2270/0171* (2013.01)

(58) Field of Classification Search
CPC ..... F17C 2250/0473; F17C 2250/0495; F17C 2250/0439; F17C 2250/032; F17C 2250/0408; F17C 2250/0421; F17C 2250/0456; F17C 2250/0469; F17C 2250/0694; F17C 2260/026; F17C 2270/0171; F17C 2265/066; F17C 2201/0104; F17C 2201/0128; F17C 2201/032; F17C 2201/035; F17C 2201/056; F17C 2221/033; F17C 2223/0161; F17C 2223/033
See application file for complete search history.

(56) References Cited

U.S. PATENT DOCUMENTS

| | | | | |
|---|---|---|---|---|
| 8,370,088 | B2 * | 2/2013 | Ammouri | F17C 13/023 702/55 |
| 9,513,155 | B2 * | 12/2016 | Harper | G01F 23/0061 |
| 10,515,426 | B2 * | 12/2019 | Legrand | G06Q 10/0831 |
| 10,704,737 | B2 * | 7/2020 | Bourgeois | F17C 5/06 |
| 10,962,175 | B2 * | 3/2021 | Belgacem-Strek | F17C 13/025 |
| 2015/0120166 | A1 * | 4/2015 | Fisher | B61C 17/02 701/101 |

FOREIGN PATENT DOCUMENTS

| | | | |
|---|---|---|---|
| FR | 2554230 | A1 | 5/1985 |
| JP | 2006-160287 | A | 6/2006 |
| JP | 2007-182936 | A | 7/2007 |
| JP | 4225698 | B2 | 2/2009 |
| JP | 2010-139055 | A | 6/2010 |
| KR | 20100066816 | A | 6/2010 |
| KR | 20160072588 | A | 6/2016 |

OTHER PUBLICATIONS

Nov. 20, 2020 Notice of Preliminary Rejection issued in Korean Patent Application No. 10-2019-7002462 with English translation.
International Search Report for PCT/FR2017/051541 (dated Sep. 28, 2017) with English language translation thereof.

* cited by examiner

METHOD AND SYSTEM FOR THE REAL-TIME CALCULATION OF THE AMOUNT OF ENERGY TRANSPORTED IN A NON-REFRIGERATED, PRESSURISED, LIQUEFIED NATURAL GAS TANK

CROSS REFERENCE TO RELATED APPLICATIONS

This application is a national phase filing under 35 C.F.R. § 371 of and claims priority to PCT Patent Application No. PCT/FR2017/051541, filed on Jun. 14, 2017, which claims the priority benefit under 35 U.S.C. § 119 of French Patent Application No. 1656241, filed on Jun. 30, 2016, the contents of each of which are hereby incorporated in their entireties by reference

BACKGROUND

The presently disclosed subject matter relates in general to a method and system for the real-time calculation of the amount of residual chemical energy in a non-refrigerated, pressurised tank, containing liquefied natural gas (LNG), without the composition of the LNG having to be determined.

The LNG fuel is a simple and effective alternative to conventional fuels, from the standpoint of $CO_2$ emissions, polluting particles and the energy density. An increasing number of actors are turning to the use thereof, such as road, sea or rail carriers.

However, contrary to conventional fuels, the volume energy density du LNG, i.e. the energy contained per volume unit of LNG, is not constant. This can be explained by two separate phenomena. Firstly, the temperature of the LNG will increase throughout its storage in a non-refrigerated, pressurised tank due to the residual inputs of heat. This rise in temperature will then generate a thermal expansion of the fluid (that can range up to more than a 20% increase in volume) and therefore a drop in its energy density.

The second phenomenon that explains the variation in the energy density of the LNG is the variation in its composition. LNG is not a refined product, therefore its composition in hydrocarbons can vary according to the deposits used.

The variability in the volume energy density of the LNG stored in a non-refrigerated reservoir can be a problem in systems that may require fine monitoring of the fuel consumption. Typically, in the case of lorries running on LNG, it can be observed, for the same reservoir containing 600 L of LNG, a difference in volume energy density of the LNG of about 15 to 20% for an identical composition of LNG, according to whether the LNG is heavy and cold or whether it is light and hot. This in practice results in a difference of hundred or so kilometres over the number of kilometres travelled, for the same amount of LNG introduced at the start, as shown in the comparative example.

Currently there is no solution to inform the operator of a pressurised tank in real-time of the remaining energy contained in the tank of LNG. The only information available to the operator is the pressure of the gas compositions, the temperature of the LNG, as well as the level of filling of the tank.

Generally during the filling of the tank by the fuel supplier, an energy calculation is made in accordance with the international standard ISO 6976.1995 using the latest known composition of LNG (and given by the supplier) and of the transferred mass of LNG. This calculation is used as a reference for the financial transaction. Thus, through this calculation at the combustion temperature of the LNG, the gross calorific value $GCV_{mass}$ of the LNG is determined, according to the equation (1), by making the hypothesis that the LNG is substantially comprised of methane, ethane, propane, isobutane, n-butane, iso-pentane, n-pentane and nitrogen:

$$GCV_{mass}(T_c) = \sum_j \left(x_j \times \frac{M_j}{M}\right) \cdot GCV_{mass_j}(T_c) \tag{1}$$

Where: —$GCV_{mass}$ represents the calorific value of the LNG, $T_c$ the combustion temperature at which the GCV is calculated, $x_j$ the mole fraction of the component j in the mixture, $M_j$ the molar mass of the component j, M the molar mass of the LNG, given by the standard NF EN ISO 6976, and $GCV_{mass_j}$ the gross calorific value of the component j given by the charts of ISO 6976.1995.

However, this calculation depends on the composition du LNG. However, this composition can be complex to determine. Indeed, the installation of a chromatograph may be necessary.

The absence of information in real time on the energy contained in the tank is a problem for several reasons: supply management: currently, the management of the supply of LNG for certain tanks (in particular those of lorries) is based solely on the volume of liquid remaining in the reservoir. However, management based on the energy demanded by the units connected to the tank would be more coherent, because this is the piece of data is needed, for example to estimate the number of kilometres that can still be travelled, avoiding shortages and running out of fuel: according to the energy density of the LNG, the volume consumption of the units can vary abruptly upwards because a greater amount of LNG may then be required in order to obtain the same amount of energy. This variation which is not planned by the operators could cause an unanticipated shortage of fuel and therefore a running out of fuel; and training of the operators: the LNG fuel market is of relatively small size. The actors in the market are for the most part professionals that have received training suitable for handling LNG and good practices. However, if the market were to grow quickly, actors with less training would need to handle and/or manage the consumption of LNG. Knowing the amount of energy contained in the tank could make it possible to simply calculate magnitudes that can be understood easily by these operators (for example the number of remaining kilometres).

With this in mind, in order to ensure the development of LNG fuel, the applicant has set up a solution that makes it possible to better plan the energy content thereof in real time using just thermodynamic parameters measured inside the tank (density of the LNG, temperature and level of the layer of LNG in the tank), and this without knowing the composition of the LNG contained in the tank.

SUMMARY

In particular, the presently disclosed subject matter includes a method for the real-time calculation of the residual chemical energy E contained in a non-refrigerated, pressurised tank, defined by its shape and its dimensions and containing a layer of liquefied natural gas (LNG), the layer of LNG being defined at a given instant t, by its temperature T, its density p, and its level h in the tank;

the method can consist of an algorithm that includes, at a given instant t, the following steps:

A. Acquisition of the characteristic parameters of the layer of LNG by measurement:
   of the level h of the layer of LNG in the tank, using a level sensor,
   of the temperature T using a temperature sensor,
   of the density ρ using a density sensor, and B. Determination of the total mass $m_t$ of the LNG contained in the tank.

The method being characterised in that the algorithm further includes, for each instant t, the following steps:

C. Calculation of the mass gross calorific value $GCV_{mass}$ of the LNG using a function f taking as parameters the temperature and the density of the liquid according to the formula:

$$GCV_{mass}=f(T,\rho)$$

D. Calculation of the residual chemical energy E according to the formula:

$$E=GCV_{mass}*m_t$$

The term mass gross calorific value of the natural gas means in terms of the presently disclosed subject matter, the amount of heat delivered by the complete combustion of a mass unit of the natural gas concerned contained in the air at a constant pressure and a given temperature. It is expressed as an amount of heat per mass unit of fuel (in the framework of the presently disclosed subject matter in $kWh/m^3$)

With input information such as the shape and the dimension of the tank, the temperature, the level of the layer of LNG and the density of the LNG, the algorithm of the method according to the presently disclosed subject matter makes it possible to calculate the actual amount of residual chemical energy contained in any tank instantly.

Furthermore, setting up this method is simple because it may not require determining the composition of the LNG, which may require the use a chromatograph or of a calorimeter in order to determine the $GCV_{mass}$ of the LNG. Indeed, usually, the mass GCV of an LNG is calculated according to its composition, generally by making the approximation that it is comprised solely of methane, ethane, propane, isobutane, n-butane, iso-pentane, n-pentane and nitrogen.

With the method according to the presently disclosed subject matter the error committed by not taking as a base the exact composition of the LNG is at most about 3%: this is the difference observed between the $GCV_{mass}$ of a heavy LNG (containing more than 10% of hydrocarbons other than methane) and the $GCV_{mass}$ of a light LNG (containing more than 99% of pure methane) at the same temperature as that of the composition concerned.

In comparison, the error that would be committed with a method different from the presently disclosed subject matter in order to determine the $GCV_{mass}$ du LNG can rapidly reach a value of about 20% if the $GCV_{mass}$ of the LNG is determined at an incorrect temperature, including and even if the composition is correct.

Advantageously, the algorithm can be either reiterated at the request of an operator using the tank, or be carried out automatically, as soon as a given interval of time Δt has elapsed, this interval able to be for example of about one second or where applicable defined optimally to take account of the latency delays according to the sensor technology used.

Determining the total mass of LNG can be carried out in different ways.

According to a first method for determining, the total mass $m_t$ of LNG contained in the tank can be done advantageously by direct measurement using a balance or stress gauges.

According to another advantageous embodiment, determining the total mass $m_t$ of LNG contained in the tank can be carried out by a calculation according to the formula:

$$m_t=\rho*g(h)$$

where: h is the level of the layer of LNG in the tank, p is the density of the LNG, and g is a function linked to the shape of the tank, giving a homogeneous value to a volume.

This method of determining the total mass $m_t$ can in particular be used in the case where the direct measurement of the mass is complicated to implement on the tank, for example when the latter is in motion during the measurement.

Advantageously, the function f that connects the mass gross calorific value $GCV_{mass}$ to the parameters T and p can be of the form:

$$f(T,\rho)=A(T)+B*\rho$$

where:

A is a constant value for a given temperature;

B is a constant independent of the composition.

The values of the two constants present in the function f are defined in the trade publications, such as LNG Industry magazine 2014, or in the scientific literature.

The presently disclosed subject matter also includes a system for calculating in real time, according to the method of the presently disclosed subject matter, the residual chemical energy E contained in a pressurised tank defined by its shape and its dimensions and containing a layer of liquefied natural gas (LNG), the layer of LNG being defined at a given instant t, by its temperature T, its density ρ, and its level h in the tank;

the system being characterised in that it includes: a calculator intended to be connected to level, temperature, and density sensors of which the tank is provided with, the calculator being able to execute the algorithm of the method according to the presently disclosed subject matter, and an MMI interface interacting with the calculator, in order to report to the operator the amount of residual chemical energy obtained by the algorithm of the method according to the presently disclosed subject matter, when it is implemented by a calculator connected to an MMI interface.

The term MMI interface means, in terms of the presently disclosed subject matter, a Man-Machine interface that allows a user to view or to be notified via any audible or mechanical signal of the information on the amount of energy remaining, for the purpose of taking the appropriate decisions for action.

As an MMI interface that can be used within the framework of the presently disclosed subject matter, mention can be made in particular of the dashboards of vehicles, computer keyboards, LED indicator lights, touchscreens and tablets, loudspeakers, etc.

According to an advantageous embodiment of the system according to the presently disclosed subject matter, the latter can be an onboard system in which: the calculator can be an onboard calculator connected to the level, temperature and density sensors, the calculator being specifically designed to execute the algorithm of the method according to the presently disclosed subject matter, and the MMI interface can also be on board or alternatively offset (if for example the vehicle is connected to a control centre.

This MMI interface, if it is on board, can be of the vehicle onboard dashboard type, interacting specifically with the onboard calculator in order to report to the operator (here the driver) the duration of the autonomy calculated according to the method of the presently disclosed subject matter.

The term calculator specifically designed to execute the algorithm of the method according to the presently disclosed subject matter means, in terms of the presently disclosed subject matter, an onboard computer including a processor combined with a dedicated storage memory and with an interface motherboard; with these elements being assembled in such a way as to provide the robustness of the "onboard computer" unit in terms of mechanical, thermodynamic and electromagnetic resistance, and as such allow for the adaptation thereof for a use in a LNG vehicle.

The system according to the presently disclosed subject matter makes it possible to easily make available to an operator the value of the amount of residual chemical energy contained in the tank, and this, even if the latter has not received any training adapted to the handling of LNG. It also makes it possible to provide this value to a third-party system, such as an onboard computer.

Advantageously, the system can further include a balance or stress gauges in order to directly measure the total mass of the LNG contained in the tank.

Finally, the presently disclosed subject matter further discloses a vehicle (land, sea or air) including a pressurised tank containing a layer of liquefied natural gas and being provided with level, temperature, and density sensors, the vehicle being characterised in that it further includes a system according to the presently disclosed subject matter.

Thanks to the system according to the presently disclosed subject matter, this vehicle can be used easily by an operator that does not have any in-depth training on handling LNG. Indeed, this system makes it possible to either display the value of the remaining energy in the tank or to transmit the value of the residual energy to a computer that can then deduce therefrom the remaining number of kilometres before another filling of the tank.

Other advantages and particularities of the presently disclosed subject matter shall result from reading the following description, given as a non-limiting example and in reference to the accompanying figures.

DETAILED DESCRIPTION OF EXEMPLARY EMBODIMENTS

Figure 1:
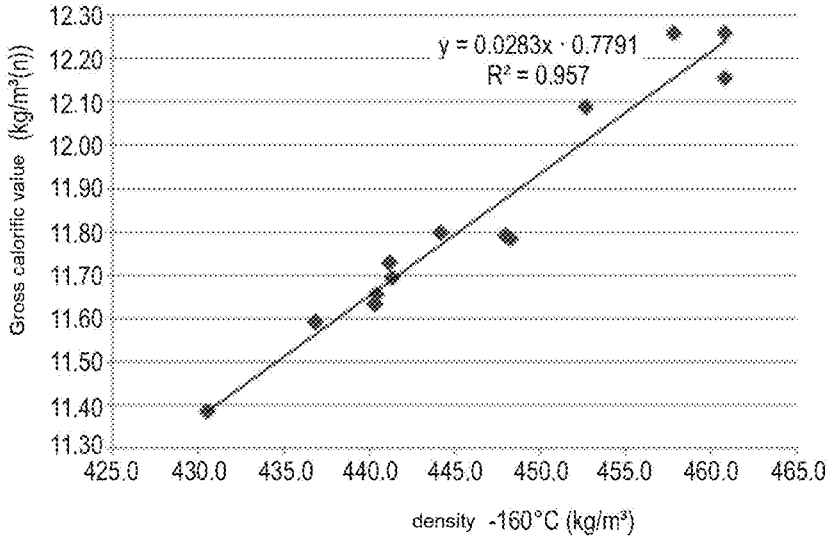
FIG. 1 shows the result of several measurements of the calorific value of the LNG according to the density of the liquid natural gas for a given temperature and composition.

FIG. 1 shows the result of a set of measurements of gross calorific value taken for different values of density of LNG at a given temperature (−160° C.). These measurement points can be connected satisfactorily (with a correlation coefficient $R^2$=0.957) via a regression line that, in this particular case at −160° C., has for equation f(ρ)=0.0283ρ−0.7791. This equation f can therefore be used as a correlation function in order to determine the $GCV_{mass}$ of the LNG when the latter is at the temperature of −160° C.

Figure 2:
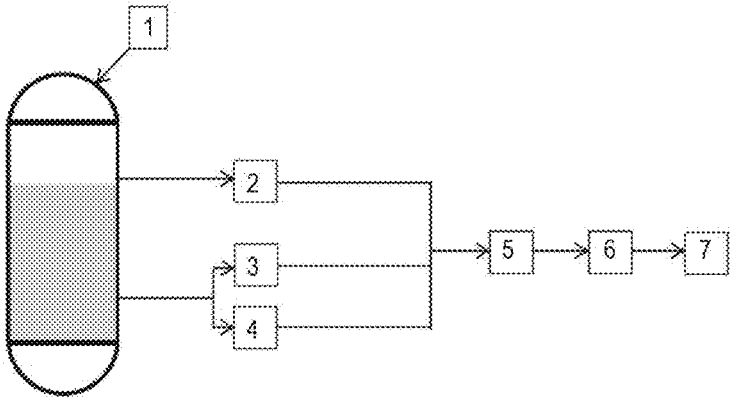
FIG. 2 shows the diagram of a particular embodiment of the measuring system according to the presently disclosed subject matter.

FIG. 2 shows the simplified diagram of a particular embodiment of the presently disclosed subject matter in the case where the tank 1 is cylindrical and vertical. When a measurement is taken, which can be done continuously, after a time interval Δt has elapsed or after an order from the operator 7, the density 4, temperature 3 and level 2 sensors present in the tank read the values of the temperature of the liquid, of the density as well as level of this liquid in the tank. This information is then sent to the calculator 5 wherein the operator 7 has entered beforehand, via a man-machine interface (MMI) 6, the shape of the tank 1 as well as the characteristic dimensions thereof, in this particular case its radius. This allows the calculator 5 to define the function g(h) used for the determination of the total mass $m_t$ of LNG contained in the tank.

Figure 3:
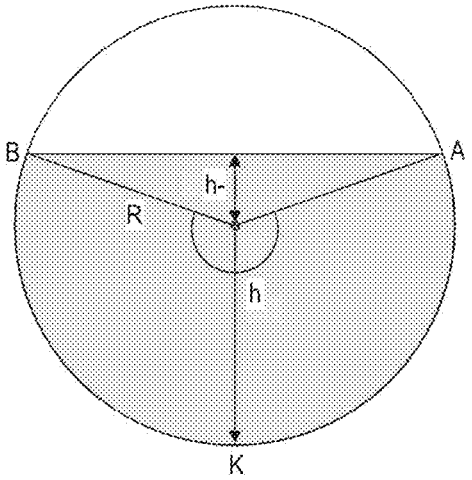
FIG. 3 shows the drawing of an example of a non-refrigerated, pressurised tank that can be used in the framework of the presently disclosed subject matter (case of a cylindrical and horizontal tank), whereon are shown the various parameters making it possible to determine the function g(h) that makes it possible to calculate the mass of LNG contained in this tank.

FIG. 3 shows the diagram of a cylindrical tank placed horizontally. In this case, the calculation of the volume of a layer of LNG in this tank is similar to calculating the area of a segment of a disc. The function g(h) is then:

$$g(h) = \left(R^2 \times \cos^{-1}\left(\frac{R-h}{R}\right) - (R-h) \times \sqrt{(R^2-(R-h)^2)}\right. \times L$$

Figure 4:
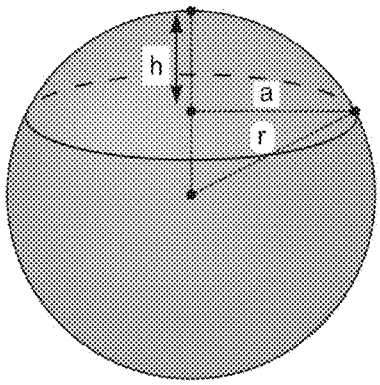
FIG. 4 shows the diagram of an example of a non-refrigerated, pressurised tank that can be used in the framework of the presently disclosed subject matter (case of a spherical tank), whereon are shown the various parameters making it possible to determine the function g(h) that makes it possible to calculate the mass of LNG contained in this tank.

If the tank is placed vertically, g(h) is then simply $g(h)=S\times R^2\times h$ FIG. 4 has a spherical tank. In this case, the calculation of the volume of a layer of LNG in this tank is similar to calculating a spherical cap. The function g(h) is then:

$$V_h = \pi \times (2R-h)^2 \times \frac{(R+h)}{3}$$

Using this information, the calculator 5 then calculates the total mass $m_t$ of LNG contained in the tank 1 and the gross calorific value $GCV_{mass}$ of the LNG, with these values then allowing the calculator to obtain the value of the residual energy E contained in the tank at the time of the measurement. The value of the residual energy E can then be supplied to the operator via the MMI 6 or be reprocessed in order to obtain information that can be understood easily, such as the number of kilometres remaining. The presently disclosed subject matter is shown in more detail in the examples hereinafter.

EXAMPLES

Example 1

This example shows the variability in the volume energy density of the LNG stored in a non-refrigerated reservoir.

For this, through a calculation using the equation (1) of standard ISO 6976:1995, the residual chemical energy E is determined in a reservoir containing 600 L (i.e. 0.6 $m^3$) of LNG in the case of a heavy and cold LNG (case a): balance at 3 bars) and in the case of an LNG of the same composition but light and hot (case b): balance at 14 bars).

Case a) of a Heavy and Cold LNG (Balance 3 Bars)

The hypothesis is made that the LNG has the following composition, indicated hereinafter in table 1.

TABLE 1

| Compound | Portion of the compound in the LNG as molar percentages |
|---|---|
| methane | 88.034 |
| ethane | 8.243 |
| propane | 2.097 |
| i-butane | 0.294 |
| n-butane | 0.407 |
| nitrogen | 0.925 |

Combustion conditions: Combustion temperature $T_c$=0° C., Pressure: 1.01325 bar, Mass GCV ($T_a$)=14.99 kWh/kg, calculated according to the equation of standard ISO 6976:1995, Temperature of the LNG T=−147.07° C., and Density=443.7153 kg/$m^3$.

$$E=0.6*\text{density}*GCV_{mass}=3990kWh$$

Case b) of a Light and Hot LNG (Balance at 14 Bars)

The LNG has the same composition as that given in table 2 hereinafter.

TABLE 2

| Compound | Portion of the compound in the LNG as molar percentages |
|---|---|
| methane | 96.367 |
| ethane | 2.623 |
| propane | 0.689 |
| i-butane | 0.17 |
| n-butane | 0.15 |
| nitrogen | 0.01 |

Combustion conditions: Combustion temperature $T_c$=0° C., and Pressure: 1.01325 bar, Mass GCV ($T_c$)=15.37 kWh/kg calculated according to the equation of standard ISO 6976:1995, Temperature of the LNG T=−112.5° C., and Density=355.65 kg/$m^3$.

$$E=0.6*\text{density}*GCV_{mass}=3279kWh$$

A difference is therefore observed of more than 17% between the energy values E calculated respectively in the cases a) and b). In other terms, for the same initial volume of LNG of 600 litres, this difference in energy can lead to a hundred kilometres travelled in addition if the LNG introduced into the reservoir is cold and heavy (case a), in relation to the number of kilometres travelled in the case b).

Example 2

Figure 5:
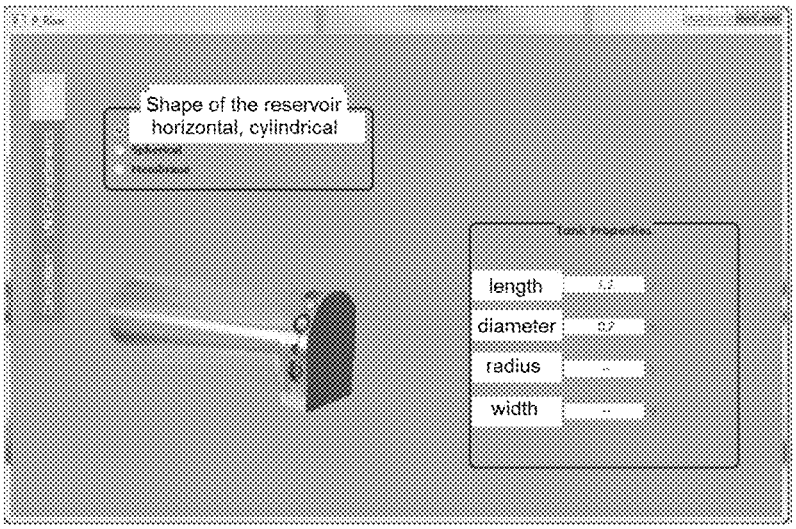
FIGS. 5 to 7 are screen captures of dashboards of a vehicle each transporting a tank of LNG that is cylindrical and horizontal, showing the input data used for the calculation of the residual chemical energy E according to the method of the presently disclosed subject matter, as well as the result of this calculation.
Figure 6:
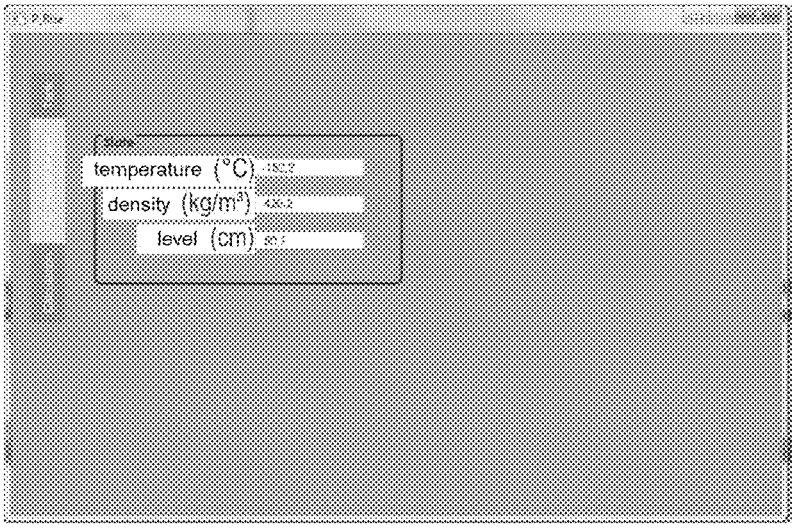
Figure 7:
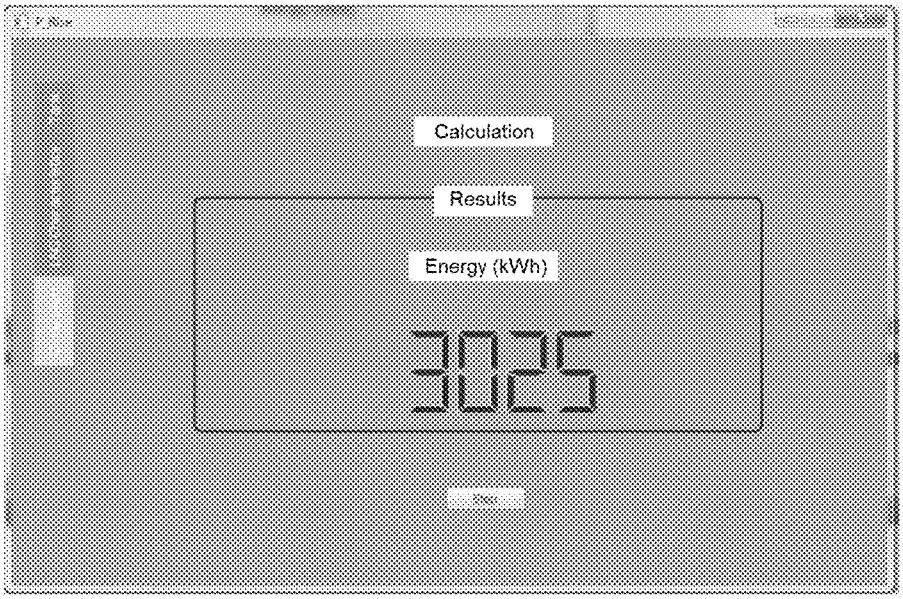

FIGS. 5 to 7 are screen captures of dashboards of a vehicle each transporting a tank of LNG that is cylindrical and horizontal, showing the input data used for the calculation of the residual chemical energy E according to the method of the presently disclosed subject matter, as well as the result of this calculation.

In particular, FIG. 5 is a screen capture of a dashboard showing the input data that is specific to the tank: Shape: cylinder, arranged horizontally in the vehicle carrying it; Dimensions: length: 1.2 m; diameter: 0.7 m FIG. 6 is a screen capture of a dashboard showing the input data specific to the layer of LNG: temperature T: −152.2° C.; density ρ: 420.2 kg/$m^3$; and level h: 0.501 m.

The invention claimed is:

1. A method for real-time calculation of residual chemical energy E contained in a pressurised tank defined by its shape and its dimensions and containing a layer of liquefied natural gas, the layer of liquefied natural gas being defined at a given instant t, by its temperature T, its density ρ, and its level h in the tank, the method including an algorithm that, at a given instant t, comprises:

acquiring the characteristic parameters of the layer of liquefied natural gas by measurement, of the level h of the layer of liquefied natural gas in the tank, using a level sensor, of the temperature T using a temperature sensor, and of the density ρ using a density sensor; and determining the total mass $m_t$ of the liquefied natural gas contained in the tank, wherein the algorithm, for each instant t, further comprises:

calculating of the mass gross calorific value $GCV_{mass}$ of the liquefied natural gas using a function f taking as parameters the temperature and the density ρ of the liquid according to the formula:

$$GCV_{mass}=f(T,\rho);\text{ and}$$

calculating of the residual chemical energy E according to the formula:

$$E=GCV_{mass}*m_t$$

wherein the function f that connects the mass gross calorific value $GCV_{mass}$ to die parameters T and ρ is according to the formula:

$$f(T,\rho)=A(T)+B*p$$

where,

A is a constant value for a given temperature, and

B is a constant independent of the composition.

2. The method according to claim 1, wherein either the algorithm is reiterated as requested by an operator using the tank, or the algorithm is carried out automatically, as soon as a given interval of time Δt has elapsed.

3. The method according to claim 1, wherein the determination of the total mass $m_t$ of liquefied natural gas contained in the tank is carried out via a direct measurement using a balance or strain gauges.

4. The method according to claim 1, wherein the determination of the total mass $m_t$ of liquefied natural gas contained in the tank is carried out via a calculation according to the formula:

$$m_t=\rho*g(h)$$

Where, h is the level of the layer of liquefied natural gas in the tank,

ρ is the density of the liquefied natural gas, and g is a function linked to the shape of the tank.

5. A system for the real-time calculation, according to the method such as defined according to claim 1, the residual chemical energy E contained in a pressurised tank defined by its shape and its dimensions and containing a layer of liquefied natural gas, the layer of liquefied natural gas being defined at a given instant t, by its temperature T, its density ρ and its level h in the tank, the system comprising:

a calculator intended to be connected to level, temperature, and density sensors of which the tank is provided with, the calculator being able to execute the algorithm of the method defined according to claim 1, and an MMI interface interacting with the calculator in order to report to the operator, the amount of residual chemical energy obtained by the algorithm of the method defined according to claim 1.

6. The system according to claim 5, which is an onboard system wherein the calculator is an onboard calculator connected to the level, temperature, and density sensors, the calculator being specifically designed to execute the algorithm of the method according to the invention, and the MMI interface is an onboard interface of the vehicle onboard dashboard type or an offset interface.

7. A vehicle comprising a pressurised tank containing a layer of liquefied natural gas and being provided with level, temperature and density sensors, the vehicle being characterised in that it includes a system such as defined according to claim 5.

* * * * *